US009771786B2

(12) United States Patent
Raglin

(10) Patent No.: US 9,771,786 B2
(45) Date of Patent: Sep. 26, 2017

(54) DOWN-HOLE GAS AND SOLIDS SEPARATOR UTILIZED IN PRODUCTION HYDROCARBONS

(71) Applicant: Spirit Global Energy Solutions, Inc., Midland, TX (US)

(72) Inventor: John M. Raglin, Midland, TX (US)

(73) Assignee: SPIRIT GLOBAL ENERGY SOLUTIONS, INC., Midland, TX (US)

( * ) Notice: Subject to any disclaimer, the term of this patent is extended or adjusted under 35 U.S.C. 154(b) by 310 days.

(21) Appl. No.: 14/606,530

(22) Filed: Jan. 27, 2015

(65) Prior Publication Data

US 2015/0211349 A1 Jul. 30, 2015

Related U.S. Application Data

(60) Provisional application No. 61/932,483, filed on Jan. 28, 2014.

(51) Int. Cl.
*E21B 43/38* (2006.01)

(52) U.S. Cl.
CPC ..... *E21B 43/38* (2013.01)

(58) Field of Classification Search
None
See application file for complete search history.

(56) References Cited

U.S. PATENT DOCUMENTS 2,429,043 A * 10/1947 Barnhart ..... F04F 1/06 166/105.1
2,810,352 A * 10/1957 Tumlison ..... E21B 43/38 137/408
2,843,053 A * 7/1958 Carle ..... E21B 43/38 166/105.5
2,969,742 A * 1/1961 Arutunoff ..... E21B 43/38 415/143
2,981,403 A * 4/1961 Goodrich ..... E21B 7/005 175/323
3,285,186 A * 11/1966 Tracy ..... E21B 43/38 55/340
3,791,444 A 2/1974 Hickey
4,072,481 A * 2/1978 Laval, Jr. ..... B01D 19/0057 55/459.1
4,555,333 A * 11/1985 Laval, Jr. ..... B04C 11/00 210/113
4,630,677 A * 12/1986 Jakob ..... E21B 43/38 166/264
4,900,433 A * 2/1990 Dean ..... B01D 19/0052 166/105.5

(Continued)

*Primary Examiner* — Shane Bomar
(74) *Attorney, Agent, or Firm* — Marsh Fischmann & Breyfogle LLP; Russell T Manning

(57) ABSTRACT

A particulate separator system and method for petroleum wells are described. An embodiment comprises a two stage separator. A fluid mixture flows into an outer casing that surrounds an inner tube. The first stage comprises a number of baffles that help to separate gas from fluid as the fluid mixture falls downward within the casing. A second stage comprises a widened inner tube and a fin causing the fluid mixture to fall radially around the inner tube and downward. As the mixture gains speed the particulate matter is forced to the periphery of the mixture by centrifugal force. A pump intake on the bottom of the inner tube pulls in the fluid while the particulate matter falls away.

19 Claims, 6 Drawing Sheets

(56) References Cited

U.S. PATENT DOCUMENTS

| | | | | |
|---|---|---|---|---|
| 5,482,117 | A * | 1/1996 | Kolpak | E21B 43/38 166/105.5 |
| 5,661,167 | A | 8/1997 | Peet | |
| 6,260,619 | B1 | 7/2001 | Svedeman | |
| 6,755,250 | B2 * | 6/2004 | Hall | E21B 43/38 166/105.5 |
| 7,946,355 | B1 * | 5/2011 | Kluge | A01K 97/01 175/18 |
| 9,249,653 | B1 * | 2/2016 | Botts | E21B 43/38 |
| 2003/0196952 | A1 | 10/2003 | Kampfen | |
| 2004/0244987 | A1 * | 12/2004 | Crews | E21B 43/38 166/369 |
| 2013/0032341 | A1 | 2/2013 | Raglin | |
| 2013/0032352 | A1 | 2/2013 | Raglin | |

* cited by examiner

DOWN-HOLE GAS AND SOLIDS SEPARATOR UTILIZED IN PRODUCTION HYDROCARBONS

CROSS REFERENCE TO RELATED INFORMATION

This application claims the benefit of U.S. Provisional Patent Application No. 61/932,483, filed Jan. 28, 2014, titled "Down-hole gas and solids separator utilized in production hydrocarbons."

TECHNICAL FIELD

The present disclosure is directed to petroleum wells and more particularly to gas and liquid separators for wells.

BACKGROUND OF THE INVENTION

Petroleum wells can be naturally flowing, injecting or can be produced by any means of artificial lift. Particulates within the production stream, which can include both liquid and gaseous products, can be both naturally occurring and man-made. Such particulates can include sand, silt, and other solids and are a natural byproduct of the producing wells. As hydrocarbons and water flow through the formation, these particulates are carried in the flow stream and can be carried into the production tubing which can cause problems with the tubing or artificial lifting mechanism, such as a rod pump.

With an increase in fracturing of wells designed to increase the well's production, there has been an increase in fracture sand, the most common man-made particulate found at the wellhead. Fracture sand is commonly introduced into the reservoir in an effort to create conductive channels from the reservoir rock into the wellbore, thereby allowing the hydrocarbons a much easier flow path into the tubing and up to the surface of the well.

Natural or man-made particulates can cause a multitude of producing problems for oil and gas operators. For example, in flowing wells abrasive particulates can "wash through" metals in piping creating leaks and potentially hazardous conditions. Particulates can also fill-up and stop-up surface flow lines, vessels, and tanks. In reservoirs whereby some type of artificial lift is required such as rod pumping, electric submersible pumps, progressive cavity, and other methods, production of particulates can reduce the life of the down-hole assembly and increase maintenance cost.

BRIEF SUMMARY OF THE INVENTION

One embodiment of the invention is a particulate separator for use with a petroleum production well producing a fluid mixture including particulate matter. The separator comprising: a first stage having an outer casing and a first inner tube, the outer casing including intake slots allowing the fluid mixture to enter the space between the outer casing and the first inner tube and to flow downward toward a pump intake, the first stage including at least one baffle in the space between the outer casing and the first inner tube, the at least one baffle assisting in separating gas from the fluid mixture. It further comprises a second stage connected to the first stage and having an outer casing and a second inner tube, the second inner tube having a diameter greater than the first inner tube to cause the velocity of the fluid to increase as it flows downward toward the pump intake, wherein the fluid mixture reaches a downward velocity sufficient to allow the particulate matter in the fluid mixture to continue downward as the fluid is drawn into the inner tube through the pump intake.

Another embodiment of the invention is a particulate separator for use with a petroleum production well producing a fluid mixture including particulate matter. This embodiment comprises a stage having an outer casing and an inner tube, the outer casing including intake slots allowing the fluid mixture to enter the space between the outer casing and the inner tube and to flow downward toward a pump intake, the stage including at least one baffle in the space between the outer casing and the inner tube, the at least one baffle assisting in separating gas from the fluid mixture.

Another embodiment of the invention is a particulate separator for use with a petroleum production well producing a fluid mixture including particulate matter. This embodiment comprises a stage having an outer casing and an inner tube, the outer casing including intake slots allowing the fluid mixture to enter the space between the outer casing and the inner tube and to flow downward toward a pump intake, the inner tube comprising at least one fin that causes the fluid mixture to flow radially around the inner tube and downward, wherein the fluid mixture reaches a downward velocity sufficient to allow the particulate matter in the fluid mixture to continue downward as the fluid is drawn into the inner tube through the pump intake.

Another embodiment of the invention is a method for separating particulates from a fluid mixture in a petroleum production well. The method comprises allowing the fluid mixture to enter an outer casing, the outer casing containing an inner tube; allowing the fluid mixture to fall downward between the outer casing and the inner tube toward a pump intake; providing at least one baffle between the outer casing and the inner tube to assist in separating gas from the fluid mixture; and widening the diameter of the inner tube, increasing the velocity of the fluid mixture sufficiently to allow particulate matter to continue downward as the fluid is drawn into the inner tube through the pump intake.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1:
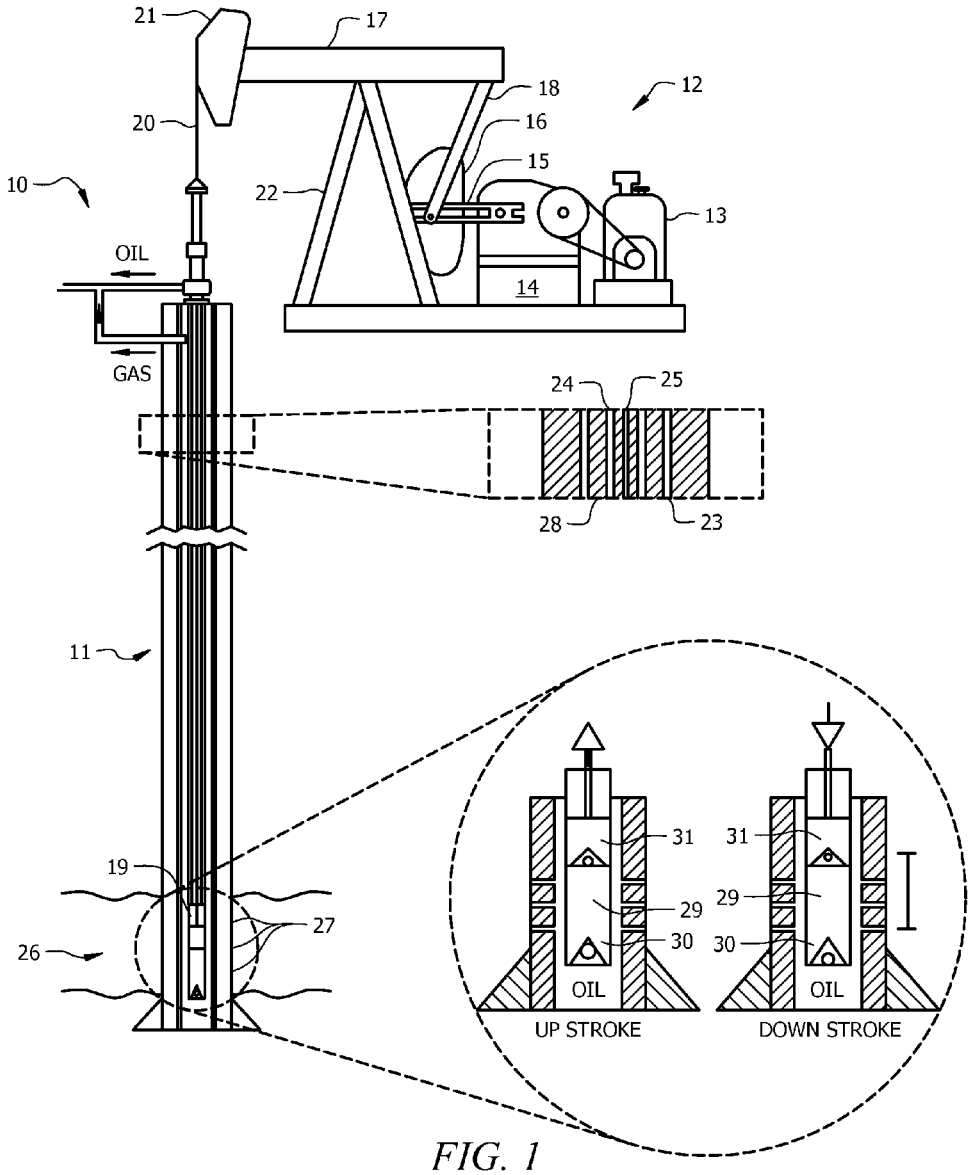
FIG. 1 (Prior Art)
FIG. 1 is a diagram of a prior art well and pump.

Referring now to FIG. 1, a diagram of a typical sucker rod pump used in oil wells is described. The sucker rod pump is described only for the purposes of illustrating the operation of a typical oil well and is not intended to be limiting in any manner as the present invention is applicable to any producing oil well including those using any means of artificial lift, such as rod pumping, electric submersible pumps, progressive cavity, and other methods.

Well 10 includes well bore 11 and pump assembly 12. Pump assembly 12 is formed by a motor 13 that supplies power to a gear box 14. Gear box 14 is operable to reduce the angular velocity produced by motor 13 and to increase the torque relative to the input of motor 13. The input of motor 13 is used to turn crank 15 and lift counter weight 16. As crank 15 is connected to walking beam 17 via pitman arm 18, walking beam 17 pivots and submerges plunger 19 in well bore 11 using bridle 20 connected to walking beam 18 by horse head 21. Walking beam 17 is supported by sampson post 22. Well bore 11 includes casing 23 and tubing 24 extending inside casing 23. Sucker rod 25 extends through the interior of tubing 24 to plunger 19. At the bottom 25 of well bore 11 in oil bearing region 26, casing 23 includes perforations 27 that allow hydrocarbons and other material to enter annulus 28 between casing 23 and tubing 24. Gas is permitted to separate from the liquid products and travel up the annulus where it is captured. Liquid well products collect around pump barrel 29, which contains standing valve 30. Plunger 19 includes traveling valve 31. During the down stroke of the plunger, traveling valve is opened and product in the pump barrel is forced into the interior of tubing 24. When the pump begins its upstroke, traveling valve 31 is closed and the material in the tubing is formed and forced up the tubing by the motion of plunger 19. Also during the upstroke, standing valve 30 is opened and material flows from the annulus in the oil bearing region and into the pump barrel.

As can be seen from FIG. 1, where the product flowing into the well bore contains sand and other particles, those particles can enter the pump and plug or cause damage to the pump mechanism, as well as the casing and tubing and above ground lines and tanks. Where there is sand and other particles mixed into the product, as can occur naturally or through fracking, it would be helpful to have a mechanism for separating the sand and particulates from the hydrocarbon product.

The present invention provides mechanisms for separating particulate matter from the well product. In preferred embodiments the mechanisms of the present invention consists of one or two individual stages for accomplishing the separation, which can work in tandem or be run as single assemblies.

Figure 2:
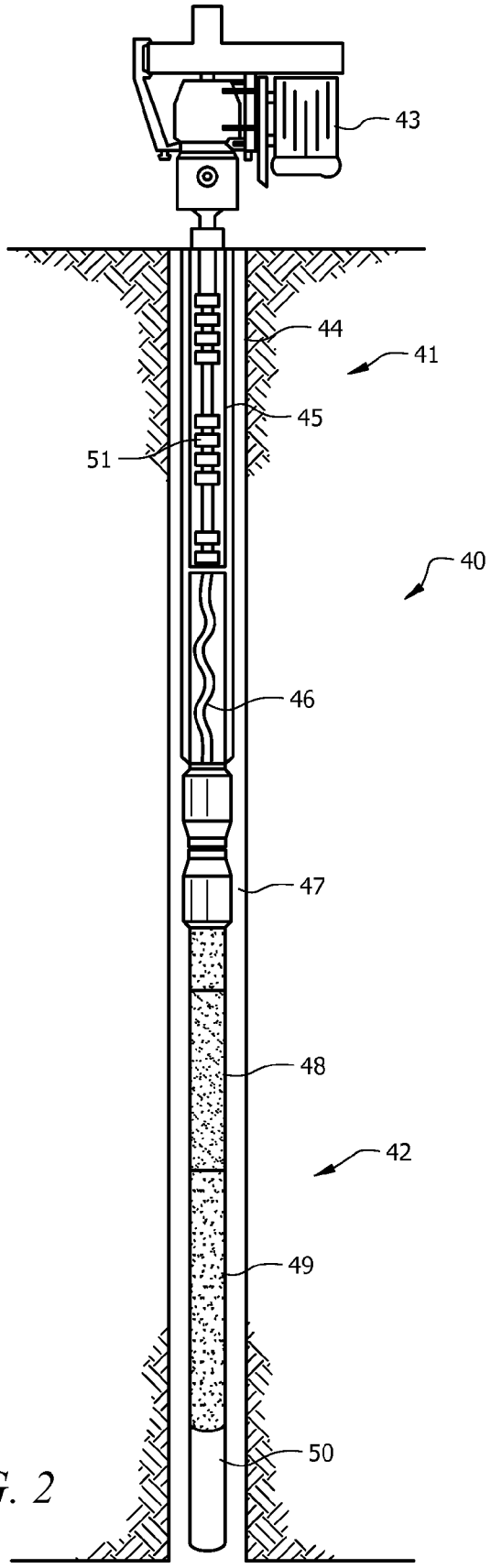
FIG. 2 is a diagram of an embodiment of the invention.

Referring now to FIG. 2, an embodiment of a down-hole sand separator according to the concepts described herein is shown used in a production well incorporating a progressive cavity pump. Well 40 is formed by casing 44 and tubing 45 and includes pump section 41 and two-stage sand separator 42. Pump section 41 includes motor 43 which drives shaft 51. Shaft 51 turns rotor and stator 46, which provides the lift for the well product entering well 40. Torque anchor 47 prevents motor 43 from turning tubing 45 within casing 44.

Sand separator stage 42 is preferably formed as a two-stage separator having stage one 49 and stage two 48 which will be discussed in greater detail with reference to FIGS. 3A and 3B. Mud anchor 50 serves as a catch area for any foreign matter or solids removed from the production fluid. While a two-stage sand separator is shown as a preferred embodiment, either stage could be used in alone or together in any combination within the well and still be within the scope of the concepts described herein.

Figure 3A:
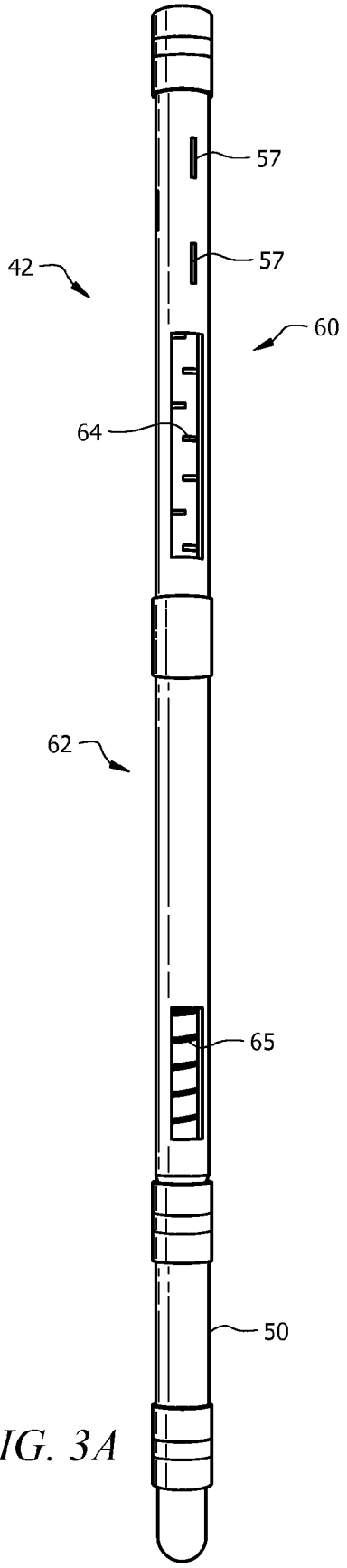
FIG. 3A is a diagram of an embodiment of the invention.
Figure 3B:
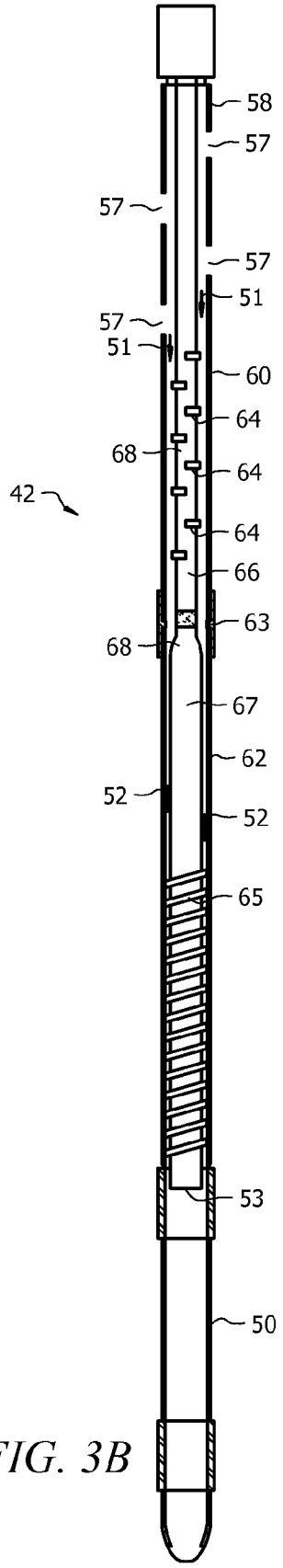
FIG. 3B is a diagram of an embodiment of the invention.

Referring now to FIGS. 3A and 3B, a down-hole separator 42 for removing gas and solids such as sand from a production flow is shown. FIG. 3A shows separator 42 with cutouts showing the interior of the tool. FIG. 3B is a side sectional view of the tool. Separator 42 connects to a mud anchor 50 which anchors the tubing 24 to the bottom of the well. Production fluids enter upper portion 60 of separator 42 through intake slots 57 in the outer casing 58 and proceed along flow path 51 between outer casing 58 and upper inner tube 66 down toward pump intake 53. Baffles 64 are placed or formed on the outer surface of upper inner tube 66. As the production fluid flows over the baffles 64, gasses in the production fluid are separated from the liquids and rise up flow path 51 as the liquid flows downward. The relatively large area of flow path 51, due to the relatively small diameter of upper inner tube 66, results in a relatively slow fluid velocity in flow path 51. This slower fluid velocity allows the gas separated by the baffles 64 to rise through the fluid. The baffling assembly runs the length of the upper inner tube 66 and the baffles are preferably welded 180 degrees apart and staggered vertically in order to "tumble" and redirect the fluid and gas. This turbulence will aid to "break-out" the gas from solution. In addition, the series of pressure drops in flow paths 51 and 52 will also assist to "release" the fluid. At the junction 63 between upper portion 60 and lower portion 62 of separator 40, upper inner tube 66 widens into lower inner tube 67. The widening 68 of the inner tube decreases the flow area in flow path 52, thereby causing the velocity of the fluid to increase as it proceeds to pump intake 53. A continuous fin or a series of fins 65 are placed in the spacing between the outer casing 58 and the lower inner tube 67 and directs the fluid mixture radially downward. The radial flow of the fluid creates a vortex that is used to further aid in the removal of particulate matter from the fluid mixture as the fluid is drawn up in to the pump input. The downward velocity of the production fluids increases as the mixture moves toward pump intake 53 and the vortex created by fin 65 forces particulate matter to the outside of the fluid flow using centrifugal forces. Under chosen velocities, the momentum of the heavier solid particulates in the fluid mixture prevents the particles from reversing direction at pump intake 53, thereby forcing the particles to continue into mud anchor 50 as the liquid in the production flow is drawn upward into pump intake 53 by the suction of the pump. The pump intake 53 can be managed to pump slower or faster depending on the user's wishes or constraints from other parameters in the system. By choosing the relative diameters of the outer casing 58 and lower inner tube 67 the downward velocity of flow path 52 and the upward, or suction velocity of flow path at the pump intake can be controlled allowing the optimum velocity for the fluid mixture to be selected to reduce any vacuum effect at pump intake 53. Larger diameters for the inner tube 52 can be designed to have a large relative diameter to reduce the intake velocity. A key to successful separation is to insure that the downward velocity of the gas, liquids, and particulates is greater than the upward intake velocity.

Through testing it has been determined that most particulates fall through liquid at a rate of 0.5 to 1.5 feet per second depending upon their mass and the viscosity of the liquid that the particulates are moving through. Once the liquid and gas now free of particulates have entered pump intake 53, the mixture is able to move into the inner tube and travel up to the surface of the well.

The baffles 64 of FIGS. 3A and 3B can take a variety of forms. The quantity, shape, size, vertical slope, spacing and more can all be varied. A preferred embodiment comprises rectangular baffles spaced 180 degrees from each other along the perimeter of the inner tube, and staggered vertically by several times the height of an individual baffle. However, other embodiments will take different forms. In some embodiments rectangular baffles will be angled downward. Another embodiment may use triangular baffles at a given angular orientation. Other situations may call for baffles more closely spaced to each other either vertically or horizontally (along the perimeter of the inner tube). Some embodiments may use baffles of various materials, whether metal, plastic, or something else. Also, some embodiments may use baffles to direct the fluid mixture to certain paths within the outer casing. Some baffles may be of a size to consume much if not all of the radial space between the inner tube and the outer casing. Other baffles may be flatter, leaving some empty space between the baffle and the outer casing. Alternatively, baffles may be attached to the outer casing instead of the inner tube.

The total assembly can be of varying lengths depending upon the application and can be designed and constructed as a single piece or multistage piece. Construction is purposely designed to guarantee success in the harsh down-hole environment of a producing well.

Figure 4:
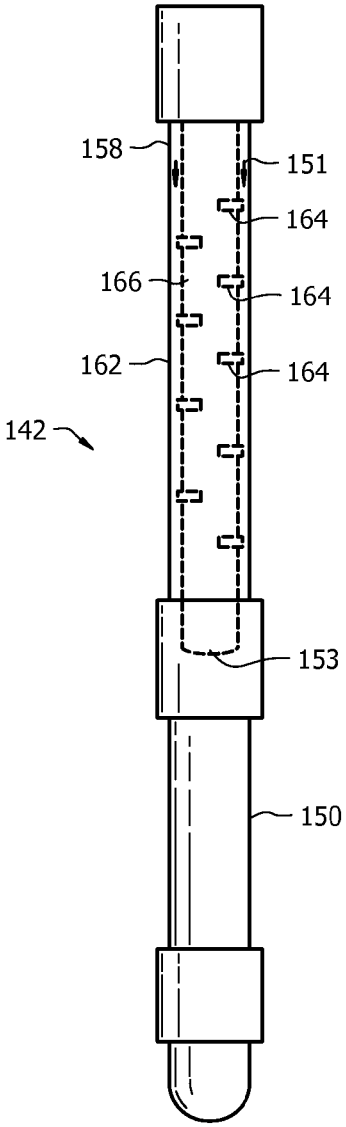
FIG. 4 is a diagram of an embodiment of the invention.

FIG. 4 displays an embodiment of a separator 142 using baffles but not fins to separate liquids, gases and solids. As sediment and production fluids fall down path 151 they are impacted by baffles 164 placed around inner tube 166. Impacts from the baffles 164 help to separate gases and liquids, allowing the gases to rise. After passing through baffles 164 the fluids enter flow intake 153. The baffles of FIGS. 3A, 3B, and 4 can take a variety of forms. A variety of shapes are possible. The baffles placement on an inner tube can take a variety of forms as well. A preferred embodiment is for the baffles to be spaced 180 degrees apart. But various configurations may be desired depending on the size of the well, tube or other factors.

Figure 5:
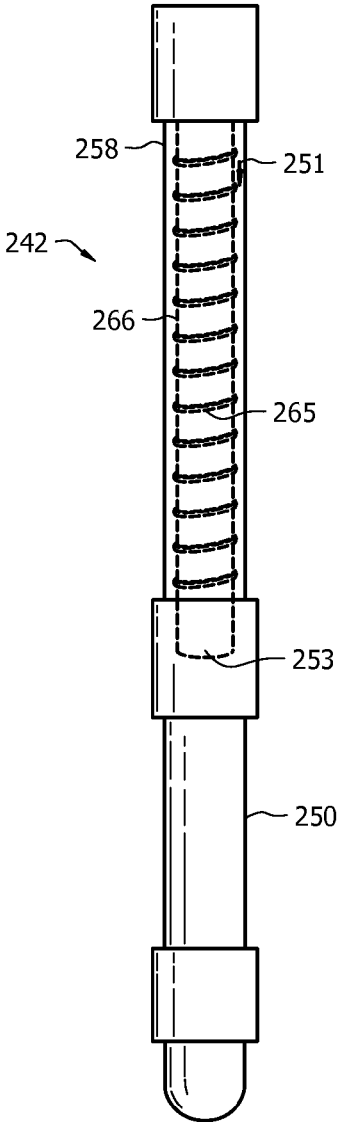
FIG. 5 is a diagram of an embodiment of the invention.

FIG. 5 shows an embodiment using fins but not baffles to separate liquids, gases and solids. As sediment and production fluids fall down path 251 they encounter the fins 265 and begin to spin around the separator 242. The impact from the fins 265 will cause some gas to separate from the fluid and rise. As the fluid picks up speed as it falls further down, heavier sediment in the fluid will spin to the outer edge of the fluid due to centrifugal forces. As the fluid leaves the fins and enters flow intake 253 the solid sediment will continue falling into the bottom of the pipe, or mud portion 250. The fins of FIGS. 3A, 3B and 5 can take a variety of forms. The fins can be serrated, or follow a waved path, or a variety of layouts. The layout can depend on the size of the well, tube or other factors.

Figure 6:
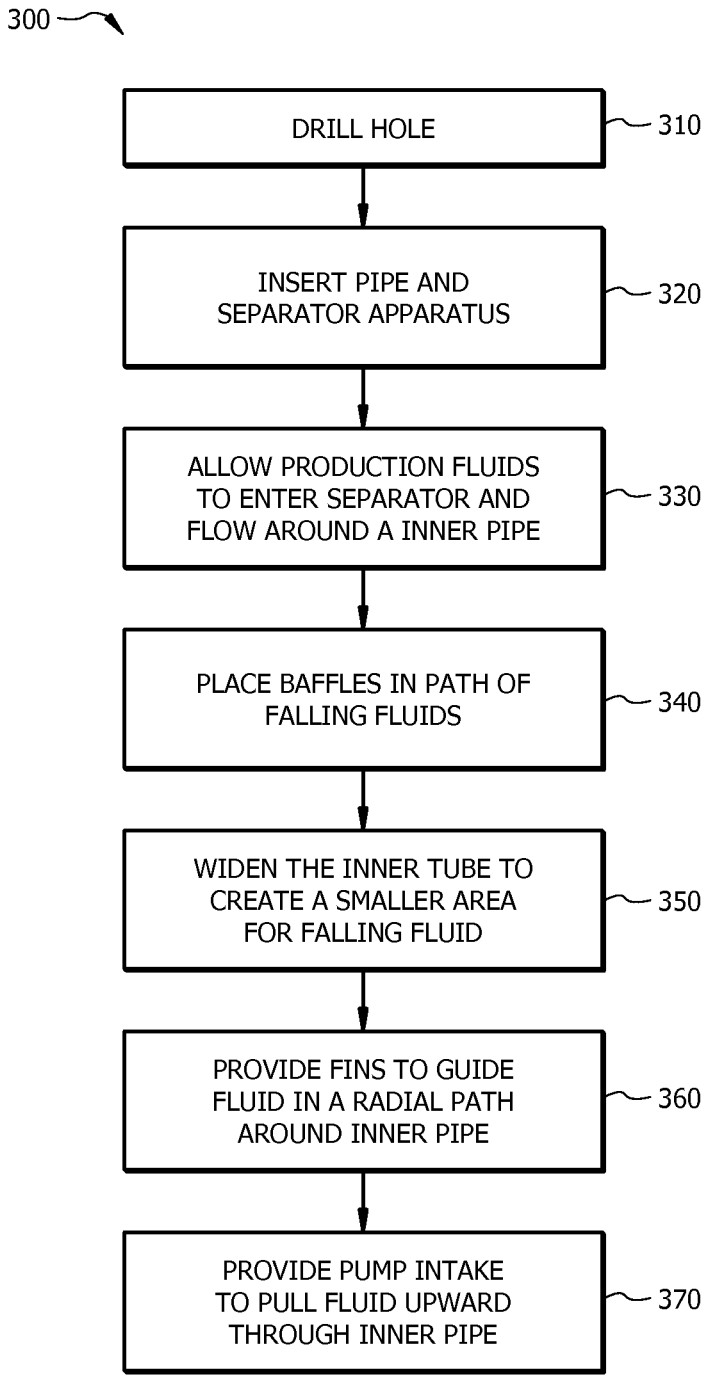
FIG. 6 is a flow-chart diagram of an embodiment of the invention.

FIG. 6 shows a method of using an embodiment of the invention. First a hole is drilled for extracting petroleum 310. Then the pipe and separator are installed within the drill bore 320. Then production fluids are allowed to enter the separator and to flow around inner pipe 330. Baffles are placed in the path of the falling fluid 340. The inner pipe is then widened to create a smaller area for the fluid to fall 350. Fins are provided that guide the fluid in a radial direction around the inner tube, while still falling 360. A pump intake is then provided to pull fluid upward through the inner pipe 370. Solids will fall down into a mud anchor or other portion of the pipe.

Figure 7:
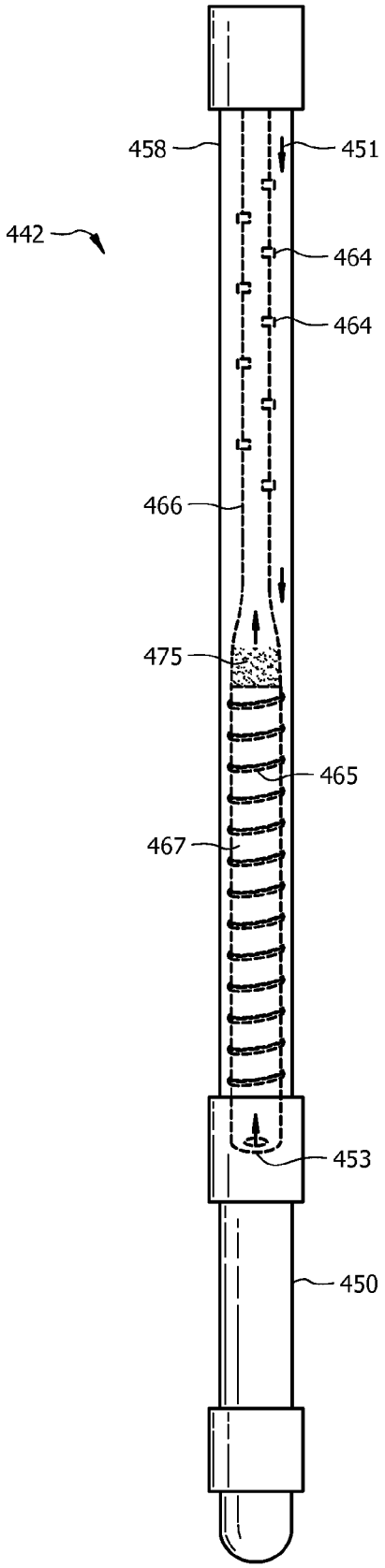
FIG. 7 is a diagram of an embodiment of the invention.

A second filter stage can also be added to the assembly. The filter stage is a tubular casing that is preferably filled with some type of filtering material that the produced gas, liquids, and particulates must pass through. As the matter flows upward from the pump intake through the filter stage, particulates are captured in the filter media and not allowed to continue to flow to the surface or to enter and damage other down-hole equipment. The filter media is held in the casing by retention screens at the input end and the output end of the casing. The filter media can be any known filter media including such media as gravel, rock, sand, wood, plastic or other permeable substance suitable for the application. FIG. 7 shows an embodiment of the invention with the added functionality of a filter within the inner tube to help filter upward flowing fluids. As in other embodiments, outer casing 458 contains an upper inner tube 466 and a lower inner tube 467. As a fluid mixture follows path 451 it encounter baffles 464 helping to separate gas from liquid. The fluid mixture then encounters fins 465 that guide the fluid mixture in a circular path around lower inner tube 467 as the fluid mixture picks up speed. Pump intake 453 will pull in fluid while particulate matter falls away. As the fluid heads upward it encounters filter 475 that helps to remove any remaining particulate matter. Filter 475 can be located at any of a variety of locations within the pipe.

Another embodiment of the invention comprises multiple baffle stages and multiple fin stages. Multiple such stages may be necessary to properly filter and separate the fluid mixture prior to pumping the fluid upward at the pump intake. Embodiments can also comprise multiple baffle stages with baffles of various size and spacing before leading to a fin stage.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A particulate separator for disposition within a well casing of a petroleum production well producing a fluid mixture including particulate matter, the separator comprising:

an upper stage having a first outer casing and a first inner tube, the first outer casing including intake slots, proximate an upper end of said first outer casing, allowing the fluid mixture to enter a first flow path between the first outer casing and the first inner tube and to flow downward toward a pump intake, the upper stage including at least one baffle in the first flow path between the first outer casing and the first inner tube, the at least one baffle assisting in separating gas from the fluid mixture; and a lower stage connected to the upper stage and having a second outer casing connected to the first outer casing and a second inner tube connected to the first inner tube, the second inner tube having a diameter greater than the first inner tube wherein a second flow path between the second outer casing and the second inner tube has a reduced flow area compared to a flow area of the first flow path to cause the velocity of the fluid to increase as it flows downward toward the pump intake, wherein the fluid mixture reaches a downward velocity sufficient to allow the particulate matter in the fluid mixture to continue downward as the fluid is drawn into the inner tube through the pump intake.

2. The particulate separator of claim 1 wherein the upper stage further comprises a plurality of baffles spaced 180 degrees from each other along the perimeter of the inner tube.

3. The particulate separator of claim 1 wherein the lower stage further comprises a fin causing the fluid to move in a radial path around the inner tube in the second flow path and downward toward the pump intake.

4. The particulate separator of claim 1 wherein the at least one baffle is attached to the inner face of the first outer casing.

5. The particulate separator of claim 1 wherein the second inner tube further comprises a filter for upward flowing fluid.

6. The particulate separator of claim 1 wherein the first inner tube further comprises a filter for upward flowing fluid.

7. The particulate separator of claim 1 wherein the at least one baffle is triangular.

8. The particulate separator of claim 1 wherein the at least one baffle is rounded.

9. The particulate separator of claim 1 wherein the at least one baffle is plastic.

10. A particulate separator for disposition within a well casing of a petroleum production well producing a fluid mixture including particulate matter, the separator comprising:

an upper stage having first outer casing and a first inner tube, the first outer casing including intake slots, proximate an upper end of said first outer casing, allowing the fluid mixture to enter a first flow path between the first outer casing and the first inner tube and to flow downward toward a pump intake, the upper stage including at least one baffle in the first flow path between the first outer casing and the first inner tube, the at least one baffle assisting in separating gas from the fluid mixture; and a lower stage connected to the upper stage and having a second outer casing connected to the first outer casing and a second inner tube connected to the first inner tube, the second inner tube having a diameter greater than the first inner tube wherein a second flow path between the second outer casing and the second inner tube has a reduced flow area compared to a flow area of the first flow path to cause the velocity of the fluid to increase as it flows downward toward the pump intake, the second inner tube comprising at least one fin that causes the fluid mixture to flow circumferentially around the second inner tube and downward, wherein the fluid mixture reaches a downward velocity sufficient to allow the particulate matter in the fluid mixture to continue downward as the fluid is drawn into the inner tube through the pump intake.

11. The particulate separator of claim 10 wherein the upper stage further comprises a plurality of baffles spaced 180 degrees from each other along the perimeter of the inner tube.

12. The particulate separator of claim 10 wherein the at least one baffle is attached to the inner face of the first outer casing.

13. The particulate separator of claim 10 wherein the second inner tube further comprises the pump intake.

14. The particulate separator of claim 10 further comprising a mud anchor.

15. The particulate separator of claim 10 wherein one of the first inner tube and the second inner tube further comprises a filter for upward flowing fluid.

16. The particulate separator of claim 10 wherein the at least one baffle is triangular.

17. The particulate separator of claim 10 wherein the at least one baffle is rounded.

18. The particulate separator of claim 10 wherein the at least one baffle is plastic.

19. The particulate separator of claim 10 further comprising a torque anchor.

* * * * *